US005516269A

United States Patent [19]

Nishioka et al.

[11] Patent Number: 5,516,269

[45] Date of Patent: May 14, 1996

[54] ZIRCONIA VANE FOR ROTARY COMPRESSORS

[75] Inventors: Takao Nishioka; Akira Yamakawa; Matsuo Higuchi; Harutoshi Ukegawa, all of Itami, Japan

[73] Assignee: Sumitomo Electric Industries, Ltd., Japan

[21] Appl. No.: 412,199

[22] Filed: Mar. 28, 1995

[30] Foreign Application Priority Data

Mar. 30, 1994 [JP] Japan ..... 6-083910

[51] Int. Cl.[6] ..... F01C 21/00

[52] U.S. Cl. ..... 418/179; 264/56

[58] Field of Search ..... 418/179; 264/56; 501/103, 152

[56] References Cited

U.S. PATENT DOCUMENTS

| | | | |
|---|---|---|---|
| 4,360,598 | 11/1982 | Otagi et al. | 264/56 |
| 5,358,645 | 10/1994 | Hong et al. | 210/761 |
| 5,376,466 | 12/1994 | Koyama et al. | 428/698 |

FOREIGN PATENT DOCUMENTS

| | | |
|---|---|---|
| 60-91 | 1/1985 | Japan . |
| 152787 | 9/1986 | Japan . |
| 9661 | 1/1993 | Japan . |
| 9660 | 1/1993 | Japan . |
| 571484 | 3/1993 | Japan . |
| 234569 | 8/1994 | Japan . |

*Primary Examiner*—Charles Freay
*Attorney, Agent, or Firm*—Jordan B. Bierman; Bierman and Muserlian

[57] ABSTRACT

A zirconia vane used in a rotary compressor, the zirconia vane being formed of a partially stabilized zirconia sintered body containing 92 through 98 molar percent of $ZrO_2$ and being stabilized with $Y_2O_3$, zirconia crystals constituting the zirconia sintered body having a mean grain diameter of 0.1 to 0.6 μm and a maximum grain diameter of not greater than 2 μm, the zirconia sintered body having a mean three-point flexural strength of not less than 120 kg/mm$^2$ measured in conformity with JIS R1601, a surface of the zirconia sintered body in contact with a rotor of the rotary compressor having a first surface roughness in a direction of rotations of the rotor, specified by a ten-point mean roughness Rz, of not greater than 1 μm and a second surface roughness in a direction perpendicular to the direction of rotation of the rotor, specified by the ten-point mean roughness Rz, of not greater than 0.6 μm. The vane is light-weight and has excellent sliding properties to effectively prevent cohesion and seizure in an atmosphere of a coolant of chlorine-free like an HFC.

8 Claims, 2 Drawing Sheets

ZIRCONIA VANE FOR ROTARY COMPRESSORS

BACKGROUND OF THE INVENTION

1. Field of the Invention

The present invention relates to a vane or an element sliding against a rotor of a rotary compressor, and more specifically to a zirconia vane preferably applicable in the atmosphere of alternative fluorocarbons used as coolants.

2. Description of the Prior Art

Chlorofluorocarbons (CFCs), which belong to the group of fluorocarbons, have heretofore been used as coolants and refrigerants in refrigerators, freezers, or the like and a representative example of CFCs is CFC12. These CFCs contain chlorine in their molecules, which effectively prevents cohesion and seizure of sliding members against a sliding surface of a compressor. Since CFCs used as the coolants also function as effective lubricants, various metals, such as cast iron, have heretofore been sufficiently used for sliding members of compressors.

Recently, the destruction of ozone in the stratosphere due to chlorine has become a very serious problem and the regulations of the chlorine-containing CFCs represented by CFC12 have been made more rigorous. Therefore, hydrofluorocarbons (HFCs) containing no chlorine in their molecules have been increasingly used as alternative fluorocarbons (hereinafter, referred to as "alternative fleon") substituting for CFCs and, especially, HFC134a or the like are greatly expected.

The HFCs and other alternative coolants containing no chlorine are, however, not expected to have lubricating functions like conventional CFCs and may cause cohesion or seizure of sliding members composed of metals. Development of novel material for sliding members having excellent sliding properties and effectively preventing cohesion and seizure has highly been strongly demanded, especially in compressors using the no chlorine-containing HFCs or other alternative coolants. Appropriate substitutes for conventional metal rotors and vanes are urgently required in rotary compressors having severer sliding conditions, such as high sliding speed and pressure on the sliding surface as compared with the reciprocating type.

As an attempt to substitute the conventional metal material, it has been proposed to prepare a rotor and vane of a rotary compressor from a ceramic material, as disclosed in Japanese Utility Model Laid-Open No. 61-152787. The ceramic materials are expected to improve the abrasion resistance and reduce the weight of the sliding members. Another example disclosed in Japanese Patent Laid-Open No. 5-71484 gives a $ZrO_2$ vane partially stabilized with $Y_2O_3$ According to the invention of this patent, partially stabilized $ZrO_2$ has a coefficient of thermal expansion, which is substantially similar to those of iron-based materials as counterpart sliding members. No gap between the sliding members efficiently prevents a leakage of the coolant and a drop in compression capacity (see the last line, first column through line 6, second column, page 2 in the specification).

Although attempts have heretofore made to prepare sliding members of rotary compressors from ceramic materials as set forth above, any improvement in the sliding properties, which has recently been demanded, cannot be expected when the conventional partially stabilized $ZrO_2$ sintered body is used in the atmosphere of alternative fleon coolants like HFCs containing no chlorine, and, thus, it is difficult to prevent cohesion or seizure.

SUMMARY OF THE INVENTION

In view of the foregoing, an object of the invention is thus to provide a $ZrO_2$ vane for a rotary compressor, which is light in weight and has improved abrasion resistance as well as excellent sliding properties to effectively prevent cohesion and seizure even in the atmosphere of the coolants of fluorocarbons like HFCs containing no chlorine.

The above object is realized by a zirconia ($ZrO_2$) vane for use in a rotary compressor, where the zirconia vane includes a partially stabilized zirconia sintered body containing 92 to 98 molar percent of $ZrO_2$ and being stabilized with $Y_2O_3$. Zirconia crystals constituting the zirconia sintered body have a mean grain diameter of 0.1 to 0.6 μm and a maximum grain diameter of not greater than 2 μm. The zirconia sintered body has a mean three-point flexural strength of not less than 120 kg/mm$^2$ measured in conformity with JIS R1601. A surface of the zirconia sintered body in contact with a rotor of the rotary compressor has a first surface roughness in a direction of rotations of the rotor, specified by a ten-point mean roughness Rz, of not greater than 1 μm and a second surface roughness in a direction perpendicular to the direction of rotations of the rotor, specified by the ten-point mean roughness Rz, of not greater than 0.6 μm.

DETAILED DESCRIPTION OF THE PREFERRED EMBODIMENTS

Figure 1:
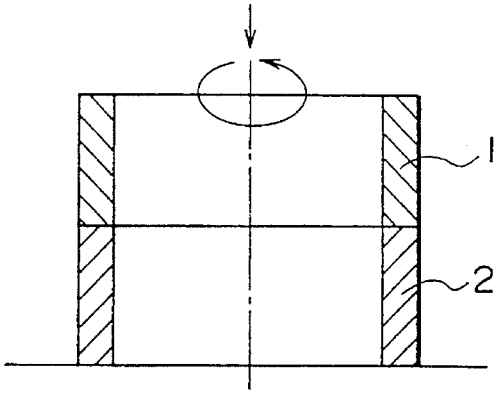
FIG. 1 is a cross sectional view schematically illustrating a ring-on-ring test used for measurement of seizing surface pressures.

The partially stabilized $ZrO_2$ sintered body constituting the zirconia vane of the invention applied to a rotary compressor contains 92 through 98 molar percent of $ZrO_2$ and is stabilized with $Y_2O_3$. $ZrO_2$ crystalline particles included in the sintered body are a mixture of tetragonal and monoclinic systems. When the content of $ZrO_2$ is less than 92 molar percent, $ZrO_2$ forms cubic crystals with no stress-inducing transformation of the crystal phase. This lowers the strength and toughness of the sintered body and fails to provide sufficient strength and abrasion resistance as a vane material. When the content of $ZrO_2$ is greater than 98 molar percent, sufficient densification cannot be achieved during sintering, which results in insufficient strength and abrasion resistance.

Addition of $Al_2O_3$ to the sintered body of $ZrO_2$and $Y_2O_3$ improves the sintering properties to give refined $ZrO_2$ crystals. $Al_2O_3$ especially has an effect in preventing abnormal grain growth and thereby making the maximum crystal grain diameter small. This improves the strength properties, abrasion resistance, and fatigue properties of the $ZrO_2$ sintered body. The content of $Al_2O_3$ is not greater than 2 molar percent with respect to the total weight of the sintered body; the preferable range is between 0.5 and 1 molar percent for further improving the sintering properties to give a sintered body with high density. The $ZrO_2$sintered body includes $Y_2O_3$ as a partial stabilizing agent. The content of $Y_2O_3$ is preferably in a range of 2 to 8 molar percent with respect to $ZrO_2$.

Vanes of a rotary compressor are exposed to the severe environment; repeated application of the stress locally to a specific area of the vane in a temperature range of 100° to 400° C. and the fluctuated temperature at the time of starting and stopping the compressor. The thermal cycle fatigue causes cracks and other defaults of the vanes, which may result in chipping or another similar trouble of the vanes in service. It has been noted that regulation of the mean grain diameter of $ZrO_2$ crystalline particles to not greater than 0.6 μm and of the maximum grain diameter of the same to not greater than 2 μm is remarkably effective for the improved fatigue properties against the thermal cycle. When the mean grain diameter of $ZrO_2$ crystalline particles is less than 0.1 μm, there is difficulty in machining the curvature of the contact surface of the vane against the rotor. The mean grain diameter of greater than 0.6 μm undesirably lowers the strength and the abrasion resistance. The preferable range for the mean grain diameter is accordingly between 0.1 and 0.6 μm.

In order to prevent cohesion and seizure in sliding movements, it is extremely important to specify the appropriate surface roughness for a sliding face of a vane in contact with a rotor. When the first surface roughness in the direction of rotations of the rotor, specified as the ten-point mean roughness Rz, exceeds 1 μm, significant cohesion and seizure of the vane against a metal rotor are observed especially in the atmosphere of fluorocarbons containing no chlorine.

The reason for such cohesion and seizure has not been elucidated clearly, but it is assumed that the high surface pressure localized on a specific area accelerates the cohesion or seizure of the specific area. When the second surface roughness in the direction perpendicular to the rotations of the rotor, specified as the ten-point mean roughness Rz, exceeds 0.6 μm, the vane damages the surface of the metal rotor to cause the abnormal abrasion of the rotor and the lowered air-tightness between the rotor and vane, which are fatal drawbacks for the compressor.

In order to satisfy the required strength properties for the vane, the $ZrO_2$ sintered body should have high density with less pores and a mean three-point flexural strength of not less than 120 kg/mm$^2$measured in conformity with JIS R1601. Throughout this specification, all flexural strengths are expressed in the three-point flexural strength specified in JIS R1601, unless otherwise specified. When the maximum pore diameter is greater than 10 μm, repeated application of the stress onto the pore causes cracking starting from the pore, which may result in chipping.

It is preferable that a certain amount of $Al_2O_3$ is further added to a starting powder material of $ZrO_2$mixed with a specific amount of $Y_2O_3$. The powder mixture was molded to a desired shape and subsequently sintered to a $ZrO_2$ vane of the invention under vacuum or in the air at a temperatures of 1,350° through 1,580° C. For removal of large pores, the $ZrO_2$sintered body thus obtained preferably underwent HIP treatment in an atmosphere of 50 through 1,000-atm argon gas at a temperatures of 1,350° through 1,600° C. for 0.5 to 2 hours.

The $ZrO_2$ vane of the invention has excellent sliding properties and effectively prevents cohesion and seizure even in the atmosphere of an alternative fleon coolant of chlorine-free fluorocarbons, such as hydrofluorocarbons (HFCs).

EXAMPLE 1

After 99.4 molar percent of $ZrO_2$ powder (mean grain diameter: 0.4 μm) partially stabilized with 3 molar percent of $Y_2O_3$ was wet-mixed with 0.6 molar percent of $Al_2O_3$ powder (mean grain diameter: 0.5 μm) in ethanol for 72 hours and dried, the resultant dried powder was molded under a pressure of 1.5ton/cm$^2$ to a ring-shaped test piece. The ring-shaped test piece was sintered under vacuum at a temperature of 1,500° C. for two hours and underwent HIP treatment in an atmosphere of 1,000-atm argon gas at a temperature of 1,450° C. for one hour.

The thus-obtained ring-shaped test piece (16 mm in inner diameter×30 mm in outer diameter×8 mm in height) comprising the partially stabilized $ZrO_2$sintered body of the invention was used as a rotatable ring 1 in a ring-on-ring test shown in FIG. 1. A ring-shaped test piece of spheroidal graphite cast iron was used for a fixed ring 2 as a counterpart. The seizing surface pressure was measured while the rotatable ring 1 was rotated at a peripheral speed of 2 m/second with the varied downward loading in a solution of an alternative fluorocarbon, HFC134a. The sliding surface was ground to have a first ten-point mean roughness Rz of 1.0 μm in a direction of rotations of the rotor and a second ten-point mean roughness Rz of 0.5 μm in a direction perpendicular to the rotations.

For the purpose of comparison, similar ring-shaped test pieces consisting of commercially available $Al_2O_3$ sintered body, SiC sintered body, $ZrO_2$sintered body, $Si_3N_4$ sintered body, and graphite cast iron were also prepared and applied to the rotatable ring 1. The seizing surface pressure was measured in the above manner, using the ring-shaped test piece of spheroidal graphite cast iron as the fixed ring 2. The results of measurement are shown in Table 1.

Table 1 also shows the flexural strength measured for each material used for the rotatable ring 1 in conformity with JIS R1601, the hardness Hv, the fracture toughness $K_{1c}$, the mean crystal grain diameter of each sintered body (mean crystal grain diameter in major axis for $Si_3N_4$ sintered body), and the coefficient of dynamic friction of each rotatable ring 1 slid against the fixed ring 2 under a fixed surface pressure of 40 kg/mm$^2$. The mean crystal grain diameter was measured in the following manner. An arbitrarily selected cross section of each sintered body was mirror-finished and etched with Ar ions. The processed section was then observed by scanning electron microscope (magnification: 5,000). The mean grain diameter and the maximum grain diameter were measured for 30 through 50 crystal grains arbitrarily selected from a field of 30 μm×30 μm in each photograph.

TABLE 1

| Samples | Materials | Flexural Strength ($kg/mm^2$) | Hardness Hv ($kg/mm^2$) | Fracture Toughness ($MPam^{1/2}$) | Mean Grain Diameter (μm) | Seizing Surface Pressure ($kg/cm^2$) | Coefficient of Dynamic Friction (μ) |
|---|---|---|---|---|---|---|---|
| 1* | Graphite Cast Iron | — | 785 | 25 | — | 40 | — |
| 2* | Commercially Available $Al_2O_3$ | 25 | 2280 | 2.8 | 2.5 | 90 | 0.09 |
| 3* | Commercially Available SiC | 45 | 2850 | 2.6 | 2.6 | 100 | 0.08 |
| 4* | Commercially Available $ZrO_2$ | 100 | 1230 | 7.1 | 1.0 | 120 | 0.05 |
| 5* | Commercially Available $Si_3N_4$ | 95 | 1530 | 4.6 | 4.3 | 130 | 0.04 |
| 6 | $ZrO_2$ of the Invention | 165 | 1420 | 5.5 | 0.3 | 190 | 0.03 |

(Note) Samples with * denote Comparative Examples.

These results show that the partially stabilized zirconia sintered body according to the present invention has a significantly high seizing surface pressure in an alternative fleon coolant containing no chlorine as compared with graphite cast iron conventionally used as a vane. The seizing surface pressure of the zirconia sintered body of the invention is also sufficiently higher than those of the other ceramic sintered bodies. The zirconia sintered body of the invention is thus preferably applicable to a vane for a compressor used in an atmosphere of an alternative fleon coolant containing no chlorine.

EXAMPLE 2

Rotatable ring samples were prepared from a partially stabilized $ZrO_2$ sintered body in the same manner as Sample No. 6 of the present invention in Example 1. A sliding surface of each ring sample was ground to have the first surface roughness in the direction of rotations and the second surface roughness in the direction perpendicular to the rotations as specified in Table 2. Both the first surface roughness and the second surface roughness were expressed as ten-point mean roughnesses Rz. The seizing surface pressures of the respective ring samples were measured in the same testing manner as Example 1. The results of measurement are shown in Table 2. After each rotatable ring sample was slid against a fixed ring of graphite cast iron under a fixed surface pressure of 40 $kg/cm^2$ for 400 hours, the abrasion height of the fixed graphite cast iron ring as a counterpart and the coefficient of dynamic friction were measured. The results of measurement are also shown in Table 2.

TABLE 2

| Samples | Rz in Direction of Rotations (μm) | Rz in Perpendicular to Rotations (μm) | Seizing Surface Pressure ($kg/cm^2$) | Abrasion Height (μm) | Coefficient of Dynamic Friction (μ) |
|---|---|---|---|---|---|
| 6-1* | 2.1 | 1.6 | 90 | 45 | 0.10 |
| 6-2* | 1.4 | 1.0 | 95 | 10 | 0.09 |
| 6-3* | 1.0 | 1.0 | 110 | 5 | 0.09 |
| 6-4* | 1.4 | 0.5 | 145 | 3 | 0.08 |
| 6-5 | 1.0 | 0.5 | 195 | 1 | 0.04 |
| 6-6 | 0.5 | 0.3 | 200 | 0 | 0.04 |
| 6-7 | 0.2 | 0.2 | 205 | 0 | 0.03 |
| 6-8 | 0.1 | 0.08 | 205 | 0 | 0.02 |

(Note) Samples with * denote Comparative Examples.

These results show that the surface roughnesses of the sliding surface of the partially stabilized $ZrO_2$ sintered body regulated to the range of the invention effectively improve the seizing surface pressure. The extremely small surface roughness does not significantly enhance the seizing surface pressure while increasing the cost for finishing. A preferable range is accordingly between 0.1 and 1 μm for both the first surface roughness in the direction of rotations and the second surface roughness in the direction perpendicular to the rotations. The partially stabilized $ZrO_2$ sintered body of the invention having the regulated surface roughnesses of the sliding surface hardly damages the counterpart member, thereby preventing abnormal abrasion of the counterpart member. Accordingly the $ZrO_2$ sintered body of the invention is preferably applied to a vane for a compressor used in the atmosphere of alternative fleon.

EXAMPLE 3

$Al_2O_3$ powder (mean grain diameter: 0.5 μm) was added, according to the compositions shown in Table 3, to $ZrO_2$ powder (mean grain diameter: 0.3 μm) partially stabilized with various molar percents of $Y_2O_3$, then wet-mixed in ethanol for 72 hours and dried. The resultant dried powder was press-molded under a pressure of 1.5 $ton/cm^2$ to a ring-shaped test piece. The quantities of $Y_2O_3$ used for the partial stabilization were 3 through 6 molar percents for examples of the invention and 1 and 10 molar percents for Comparative Examples. Each ring-shaped test piece was sintered in the air at sintering temperatures of 1,350° through 1,580° C. for one to five hours. Some of the test pieces further underwent HIP treatment in an atmosphere of 1,000-atm argon gas at a temperatures of 1,400° through 1,550° C. for one hour.

Table 3 also shows the amount of $Y_2O_3$ added to $ZrO_2$ powder, the content of $Al_2O_3$ included in the sintered body, and the presence of HIP treatment for each sample.

TABLE 3

| Samples | Amount of $Y_2O_3$ added (mole %) | Content of $Al_2O_3$ (mole %) | HIP treatment |
|---|---|---|---|
| 7* | 1 | 0 | YES |
| 8* | 1 | 0.2 | YES |
| 9* | 1 | 0.7 | YES |
| 10* | 1 | 2 | YES |
| 11 | 3 | 0 | YES |
| 12 | 3 | 0.2 | YES |
| 13 | 3 | 0.7 | YES |
| 14 | 3 | 2 | YES |
| 15* | 3 | 0 | NO |
| 16 | 3 | 0.2 | NO |
| 17 | 3 | 0.7 | NO |
| 18 | 3 | 2 | NO |
| 19 | 5 | 0 | YES |
| 20 | 5 | 0.2 | YES |
| 21 | 5 | 0.7 | YES |
| 22 | 5 | 2 | YES |
| 23 | 5 | 0.2 | NO |
| 24 | 5 | 0.7 | NO |
| 25* | 5 | 2 | NO |
| 26* | 9 | 3 | NO |
| 27* | 10 | 0.2 | YES |
| 28* | 10 | 0.7 | YES |
| 29* | 10 | 2 | YES |

(Note) Samples with * denote Comparative Examples.

maximum pore diameter were measured in the following manner. An arbitrarily selected cross section of each sintered body was mirror-finished and etched with Ar ions. The processed section was then observed by a light microscope or a scanning electron microscope (magnification: 200 to 5,000). The maximum crystal grain diameter and the maximum pore diameter were measured within a selected field of 0.5 mm×0.5 mm in each photograph. The mean grain diameter was also measured for 30 through 50 zirconia crystal grains arbitrarily selected.

Figure 2:
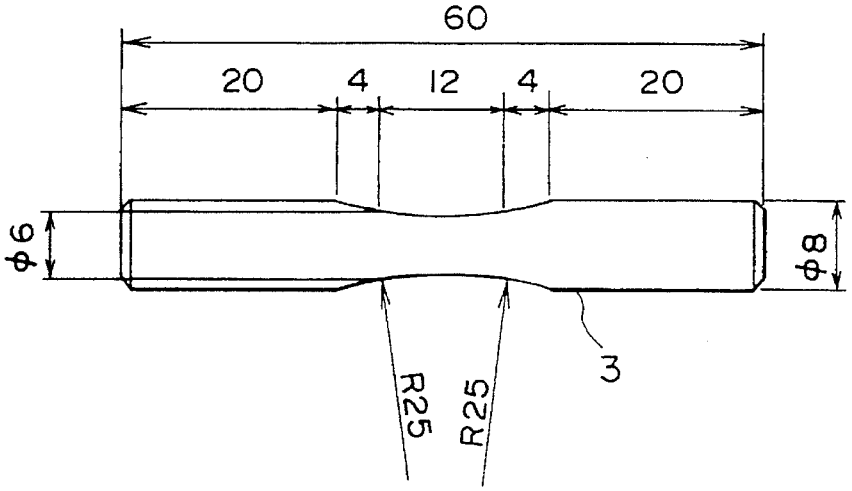
FIG. 2 is a side view illustrating a test piece used for Ono's rotating bending fatigue test.
Figure 3:
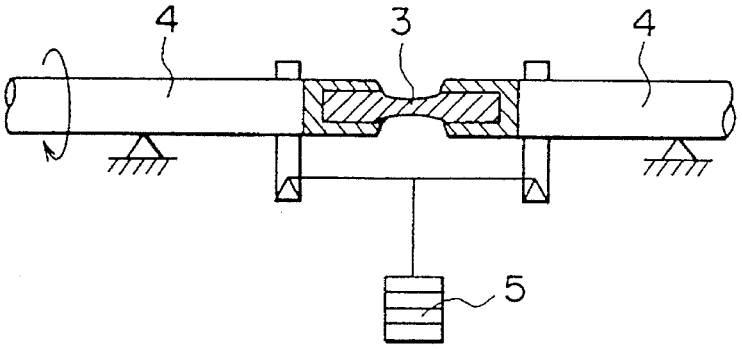
FIG. 3 is a partially cutaway cross sectional view showing a process of the Ono's rotating bending fatigue test.
Figure 4:
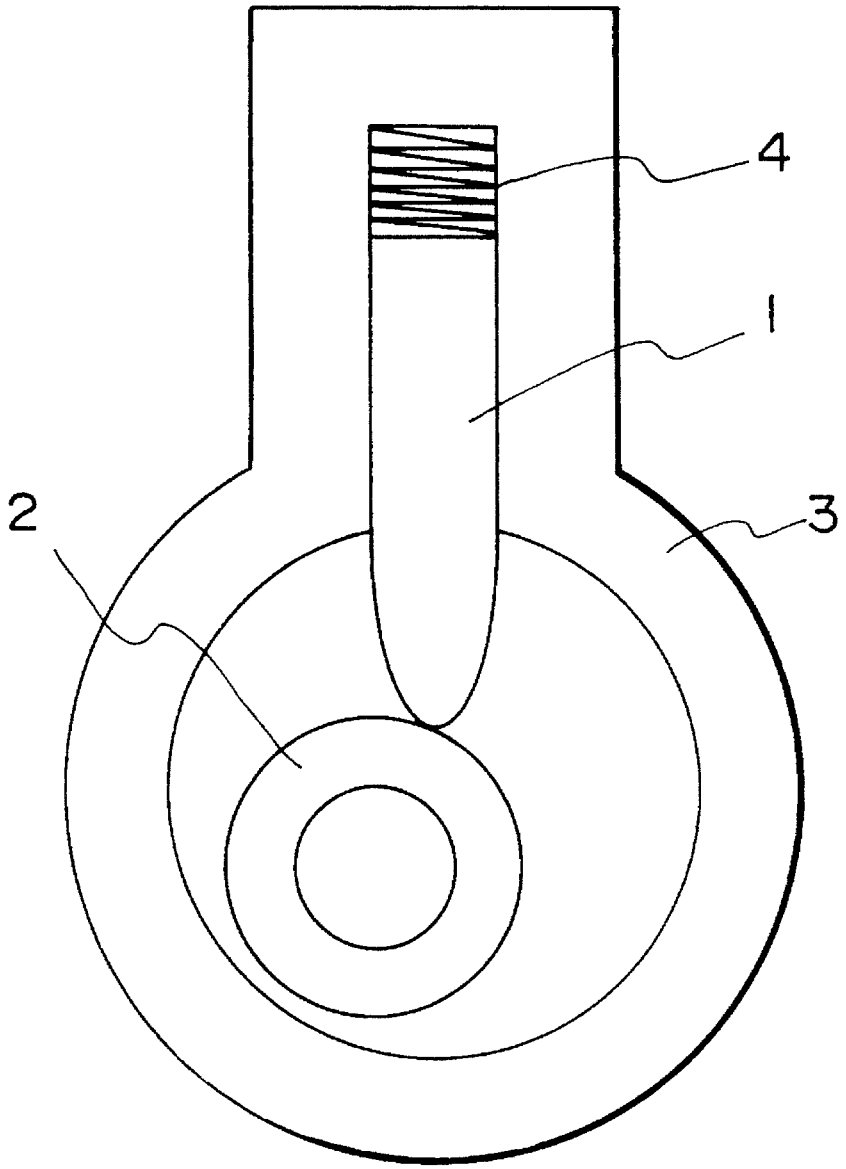
FIG. 4 is a schematic representation of a zirconia vane according to the invention.

The first surface roughness and the second surface roughness of the sliding surface were adjusted for rotatable ring samples composed of the respective sintered bodies in the same manner as Example 1. The seizing surface pressure was also measured in the same manner as Example 1. Table 4 shows measurements of the seizing surface pressure. A test piece 3 shown in FIG. 2 was prepared from each sintered body, and placed in a sample fixation unit 4 according to Ono's rotating bending fatigue test schematically shown in FIG. 3. The dimensions of the test piece are shown in millimeter units in FIG. 2. The fatigue limit under the repeated rotations of $10_7$ was then measured with application of loading by a weight 5. The measurements are also shown in Table 4.

TABLE 4

| Samples | Flexural Strength (kg/mm²) | Hardness Hv (kg/mm²) | Mean Grain Diameter (μm) | Maximum Grain Diameter (μm) | Maximum Pore Diameter (μm) | Seizing Surface Pressure (kg/cm²) | Fatigue Limit (kg/mm²) |
|---|---|---|---|---|---|---|---|
| 7* | 53 | 1005 | 0.4 | 0.6 | 18 | 155 | 5 |
| 8* | 83 | 1245 | 0.5 | 1.5 | 15 | 160 | 10 |
| 9* | 98 | 1220 | 0.8 | 1.8 | 15 | 165 | 15 |
| 10* | 95 | 1195 | 0.9 | 2.1 | 15 | 160 | 15 |
| 11 | 120 | 1380 | 0.4 | 1.1 | 5 | 180 | 30 |
| 12 | 145 | 1390 | 0.4 | 1.0 | 3 | 190 | 45 |
| 13 | 182 | 1435 | 0.3 | 0.8 | 3 | 200 | 60 |
| 14 | 135 | 1365 | 0.5 | 1.0 | 3 | 190 | 40 |
| 15* | 115 | 1195 | 0.5 | 1.2 | 15 | 165 | 25 |
| 16 | 124 | 1240 | 0.4 | 1.0 | 3 | 180 | 30 |
| 17 | 136 | 1380 | 0.3 | 0.7 | 3 | 185 | 35 |
| 18 | 122 | 1285 | 0.4 | 0.9 | 3 | 180 | 30 |
| 19 | 120 | 1285 | 0.6 | 1.4 | 8 | 170 | 30 |
| 20 | 138 | 1320 | 0.5 | 1.2 | 3 | 190 | 40 |
| 21 | 154 | 1400 | 0.4 | 1.0 | 3 | 195 | 50 |
| 22 | 126 | 1300 | 0.6 | 1.6 | 3 | 185 | 35 |
| 23 | 120 | 1215 | 0.6 | 1.8 | 5 | 175 | 30 |
| 24 | 132 | 1320 | 0.6 | 1.6 | 5 | 180 | 30 |
| 25* | 108 | 1200 | 0.8 | 2.1 | 10 | 150 | 10 |
| 26* | 94 | 1131 | 0.9 | 2.3 | 8 | 155 | 15 |
| 27* | 85 | 1105 | 0.9 | 2.2 | 8 | 160 | 10 |
| 28* | 90 | 1145 | 0.8 | 2.1 | 8 | 155 | 15 |
| 29* | 75 | 1100 | 1.0 | 2.4 | 8 | 155 | 10 |

(Note) Samples with * denote Comparative Examples.

The flexural strength, the hardness (Hv), the mean grain diameter and maximum grain diameter of $ZrO_2$crystal grains, and the maximum pore diameter were measured for the respective samples of partially stabilized $ZrO_2$ sintered bodies thus obtained, in the same manner as Example 1. The results of measurements are shown in Table 4. The mean and maximum grain diameters of zirconia crystal grains and the These results show that the partially stabilized $ZrO_2$ sintered body of the invention, which has been prepared under the properly selected sintering conditions with proper quantities of $ZrO_2$ and $Al_2O_3$ and have suitably controlled crystal grain diameter of $ZrO_2$ and pore diameter, have excellent flexural strength, fatigue limit, and seizing surface pressure, as a material for use in sliding members. The $ZrO_2$sintered body of the invention is favorably applied to a vane for a compressor working in an atmosphere of an alternative fleon coolant containing no chlorine.

The zirconia vane of the invention applicable to a rotary compressor effectively prevents cohesion and seizure against a cast iron or another metal rotor as a counterpart even in a coolant of alternative fluorocarbons containing no chlorine. The zirconia vane of the invention does not cause abnormal abrasion of the metal rotor but has excellent abrasion resistance and fatigue resistance. The zirconia vane manufactured at a relatively low cost is light in weight and has a sufficient reliability.

What is claimed is:

1. A zirconia vane used in a rotary compressor, said zirconia vane comprising a partially stabilized zirconia sintered body containing 92 through 98 molar percent of $ZrO_2$ and being stabilized with $Y_2O_3$, zirconia crystals constituting said zirconia sintered body having a mean grain diameter of 0.1 to 0.6 μm and a maximum grain diameter of not greater than 2 μm, said zirconia sintered body having a mean three-point flexural strength of not less than 120 $kg/mm^2$ measured in conformity with JIS R1601, a surface of said zirconia sintered body in contact with a rotor of said rotary compressor having a first surface roughness in a direction of rotations of said rotor, specified by a ten-point mean roughness Rz, of not greater than 1 μm and a second surface roughness in a direction perpendicular to the direction of rotations of said rotor, specified by the ten-point mean roughness Rz, of not greater than 0.6 μm.

2. A zirconia vane in accordance with claim 1, wherein said partially stabilized zirconia sintered body contains 2 or less molar percent of $Al_2O_3$.

3. A zirconia vane in accordance of claim 1, wherein said partially stabilized zirconia sintered body contains pores having a maximum pore diameter of not greater than 10 μm.

4. A zirconia vane in accordance with claim 2, wherein said partially stabilized zirconia sintered body contains pores having a maximum pore diameter of not greater than 10 μm.

5. A zirconia vane in accordance with claim 1, said zirconia vane being used in an atmosphere of a fluorocarbon containing no chlorine.

6. A zirconia vane in accordance with claim 2, said zirconia vane being used in an atmosphere of a fluorocarbon containing no chlorine.

7. A zirconia vane in accordance with claim 3, said zirconia vane being used in an atmosphere of a fluorocarbon containing no chlorine.

8. A zirconia vane in accordance with claim 4, said zirconia vane being used in an atmosphere of a fluorocarbon containing no chlorine.

* * * * *